US005791120A

United States Patent [19]

De Young

[11] Patent Number: 5,791,120

[45] Date of Patent: Aug. 11, 1998

[54] TRAY SEALING PLATEN AND SEAL APPARATUS

[75] Inventor: Perry R. De Young, Grand Rapids, Mich.

[73] Assignee: Oliver Products Company, Grand Rapids, Mich.

[21] Appl. No.: 867,555

[22] Filed: Jun. 2, 1997

[51] Int. Cl.[6] ..... B65B 51/10

[52] U.S. Cl. ..... 53/329.3; 156/69; 156/308.4

[58] Field of Search ..... 53/329.3; 156/583.1, 156/69, 308.4; 100/54, 61, 237, 211, 295; D23/434, 456, 499; 277/639, 649, 644

[56] References Cited

U.S. PATENT DOCUMENTS

| | | | |
|---|---|---|---|
| 3,190,051 | 6/1965 | Souligney | 53/478 |
| 3,283,469 | 11/1966 | McBrady | 53/485 |
| 3,724,161 | 4/1973 | Vermeulen | 53/329.3 |
| 4,572,515 | 2/1986 | Grazioli | 277/649 |
| 4,583,350 | 4/1986 | Artusi | 53/478 |
| 4,707,213 | 11/1987 | Mohr et al. | 53/329.3 |
| 5,010,714 | 4/1991 | Medwed | 53/373.7 |
| 5,331,791 | 7/1994 | Fux | 53/373.7 |
| 5,335,592 | 8/1994 | Rottger | 100/151 |
| 5,345,747 | 9/1994 | Raque | 53/373.7 |
| 5,379,572 | 1/1995 | Giovannone | 53/373.7 |
| 5,385,003 | 1/1995 | Nixon | 53/485 |
| 5,419,097 | 5/1995 | Gorlich et al. | 53/329.3 |

*Primary Examiner*—Daniel Moon
*Assistant Examiner*—John Paradiso
*Attorney, Agent, or Firm*—Price, Heneveld, Cooper, DeWitt and Litton

[57] ABSTRACT

A peripheral resilient seal, and seal and platen, the platen having a container tray receiving cavity and a peripheral groove around the cavity and receiving the seal. The seal has side ribs deformable upon insertion into the groove, and a shoulder extending beyond the groove to abut the platen.

12 Claims, 3 Drawing Sheets

TRAY SEALING PLATEN AND SEAL APPARATUS

BACKGROUND OF THE INVENTION

In copending U.S. patent application Ser. No. 08/629,269, filed Apr. 8, 1996, entitled DRAWER ACTION TRAY SEALING MACHINE, incorporated herein by reference, is set forth a unique apparatus for sealing lids to tray containers for retaining contents such as food. The apparatus has significant advantages over the prior apparatuses available.

Over a period of use, however, it has been determined that the peripheral flexible seal of this apparatus, which surrounds the tray receiving cavity and presses the container flange against the lid, tends to deform. Periodically it needs replacement. Presently there are two main techniques for accomplishing this removal and replacement. The first technique is to glue a sheet as of silicone polymer to the tray holder platen and trim it out, or conceivably die cut it and glue it down. The second technique is to take an O-ring rope, cut a peripheral groove in the platen, and then glue or press the rope into the groove.

The above first technique involves long assembly time and lead time, with resulting loss of production time, as well as considerable labor. The second technique requires machining time and labor.

Consequently, when the gasket wears or becomes distorted so as to need replacement, the purchaser of the apparatus is normally not sufficiently skilled to accomplish this task. Hence, a service team or person must be brought in, or the apparatus shipped back to the manufacturer for repair.

If an O-ring seal were to be employed, the O-ring would not provide the most desirable choice because an O-ring does not engage and seal the full width of the tray flange. Therefore, the peel strength of the lid to the flange is relatively low so the lid can come loose with undesirable results. This loss of peel strength is significant, especially for paper based trays. If the lid is not sealed at the outer lid edge, the overlapping edge tends to become loose and propagate inwardly.

SUMMARY OF THE INVENTION

An object of this invention is to provide a novel seal and platen arrangement, and a novel seal for the apparatus, such that the tray lid sealing apparatus is capable of being rapidly and simply repaired by replacement of the sealing member, without requiring workmen of special skills, or return of the apparatus to the manufacturer.

The platen of the invention has a peripheral groove around and closely adjacent the tray receiving cavity. A specially configurated, resilient, polymeric gasket seal is fitted down into the groove, the gasket seal having laterally projecting deformable ribs which become deformed upwardly when the gasket is forcefully inserted down into the groove which has a width less than that of the gasket. The gasket seal also has an integral lip extending from the head portion to protrude over the shoulder which is between the groove and the tray receiving cavity.

These and other features, advantages and objects of the present invention will be further understood and appreciated by those skilled in the art by reference to the following specification, claims and appended drawings.

DETAILED DESCRIPTION OF PREFERRED EMBODIMENT

Figure 6:
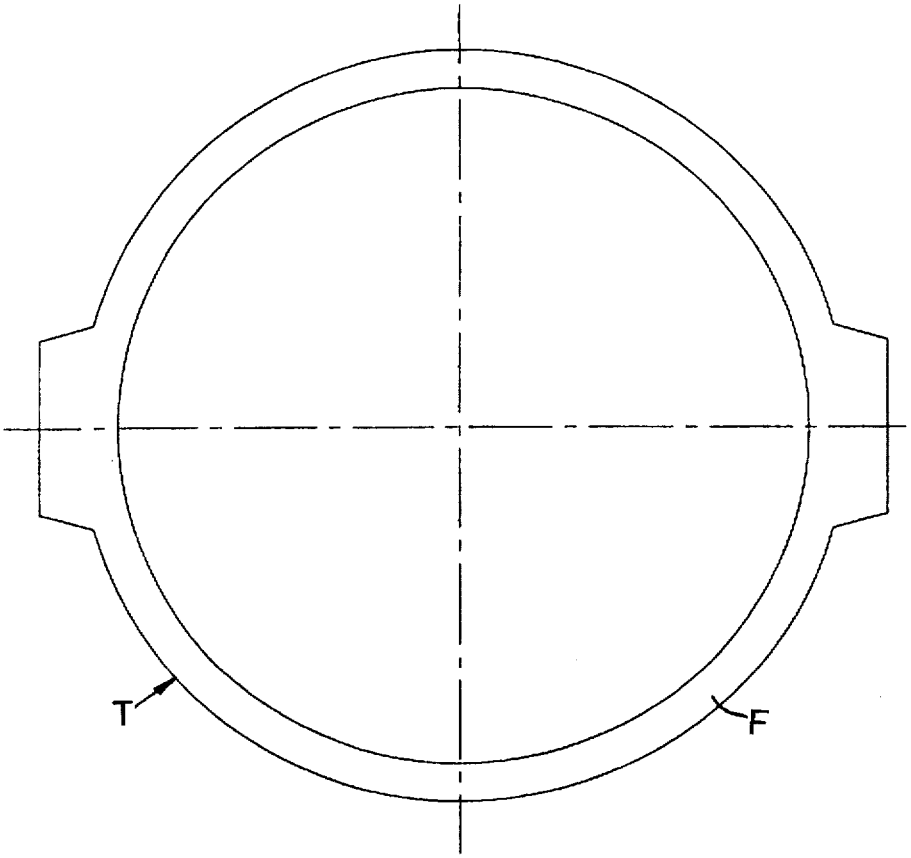
FIG. 6 is a top plan view of a representative tray container of the type to be enclosed with a lid according to this invention.
Figure 7:
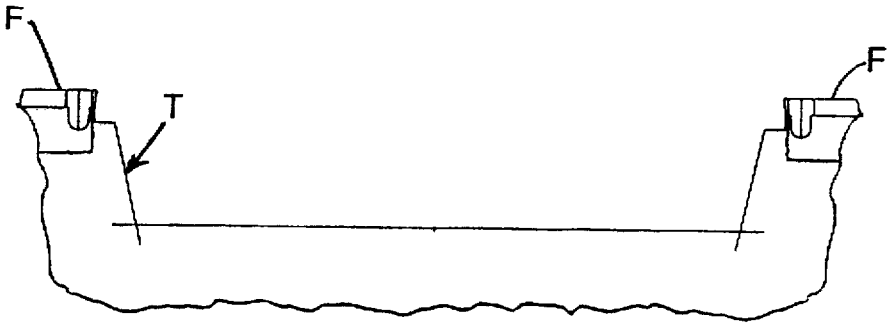
FIG. 7 is an elevational view of the tray retained by the platen and resting on the peripheral seal.

Referring now specifically to the drawings, the tray sealing apparatus is of the type described and shown in the previously identified copending application Ser. No. 08/629,269 incorporated herein by reference. It includes a platen or support 18 which can be moved into and out of position for heat sealing of a lid to a tray as described in the above application. This platen has one or more tray receiving cavities 34, here shown to be two in number, for reception of individual tray type containers T (FIGS. 6 and 7). Each such tray normally has an integral peripheral flange F projecting laterally outwardly from the tray. This flange is typically in a single plane, and not only provides strength to the container but also a surface for sealingly engaging a lid to close the container.

Figure 1:
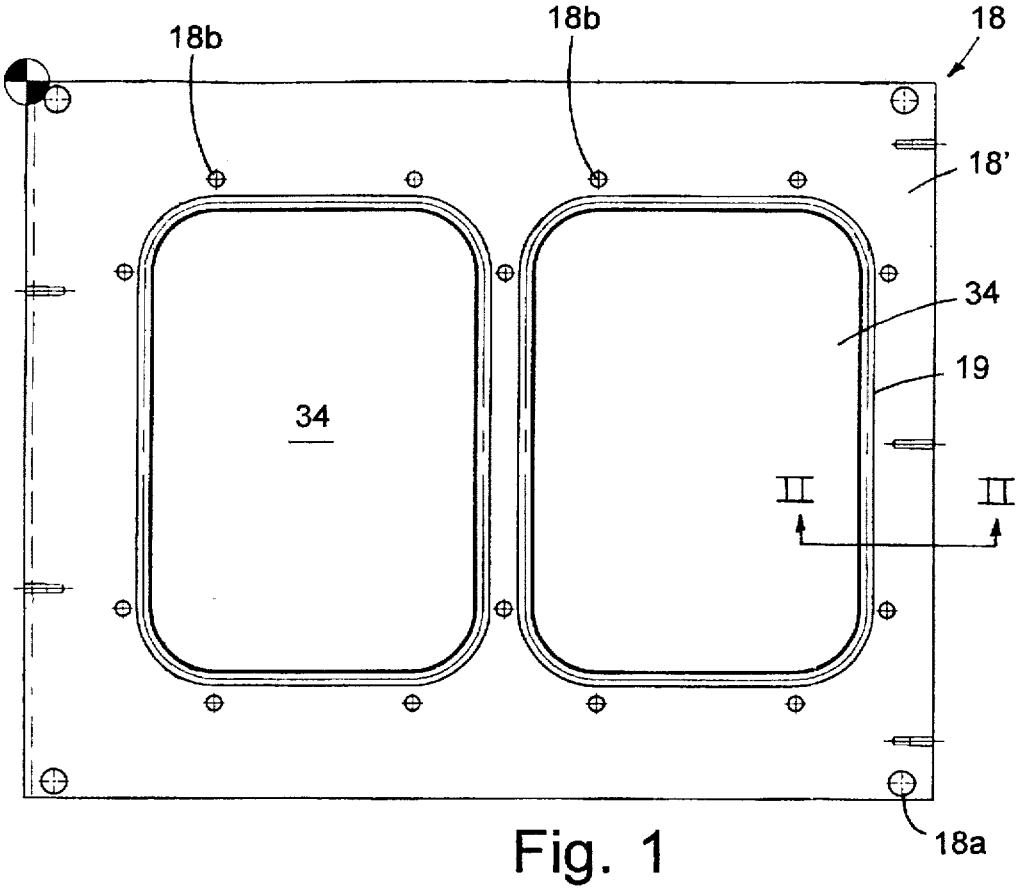
FIG. 1 is a plan view of the tray sealing platen.
Figure 2:
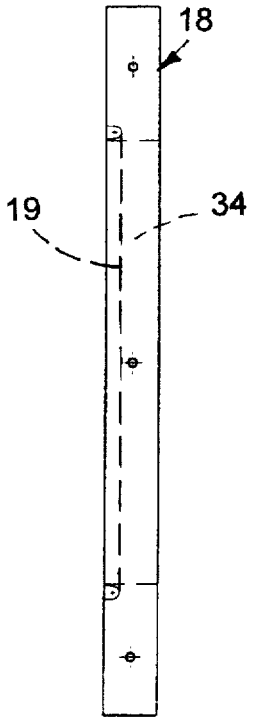
FIG. 2 is an end elevational view of the platen.
Figure 3:
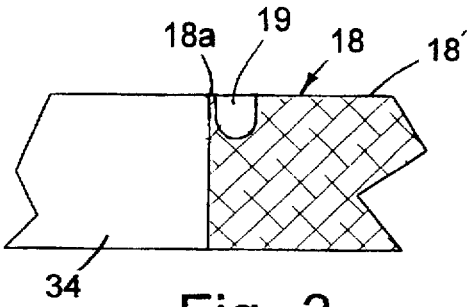
FIG. 3 is an enlarged, fragmentary, cross sectional view of a portion of the platen taken on plane III—III of FIG. 1.

Platen 18 has a flat area 18' which surrounds and extends away from cavities 34. The platen is mounted at its four comers **18*a*. Formed into top surface 18' of platen 18 are peripheral grooves 19 (FIG. 3) which respectively extend completely around each cavity 34. This groove preferably has a pair of spaced parallel side walls and a concave bottom. A small shoulder 18*a* remains between cavity 34 and groove 19**.

Figure 4:
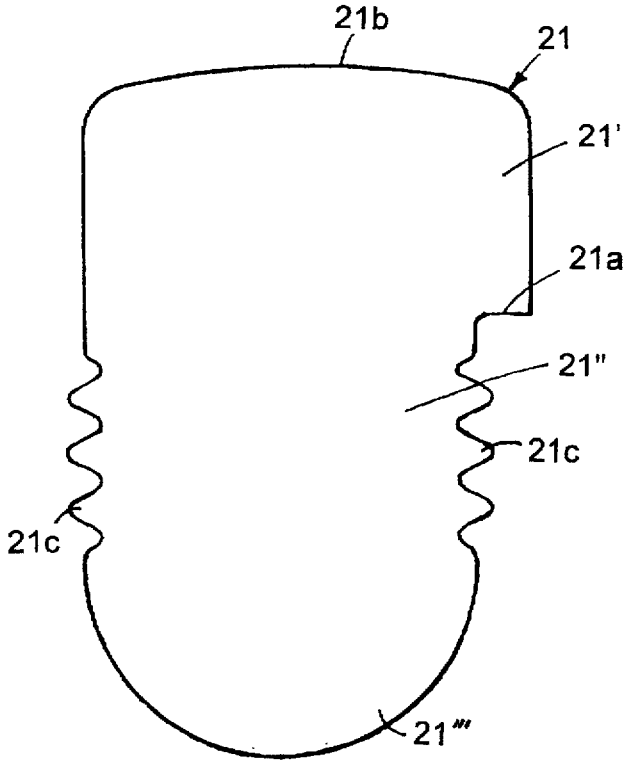
FIG. 4 is a cross sectional view of the novel peripheral seal useful for combining with the platen.
Figure 5:
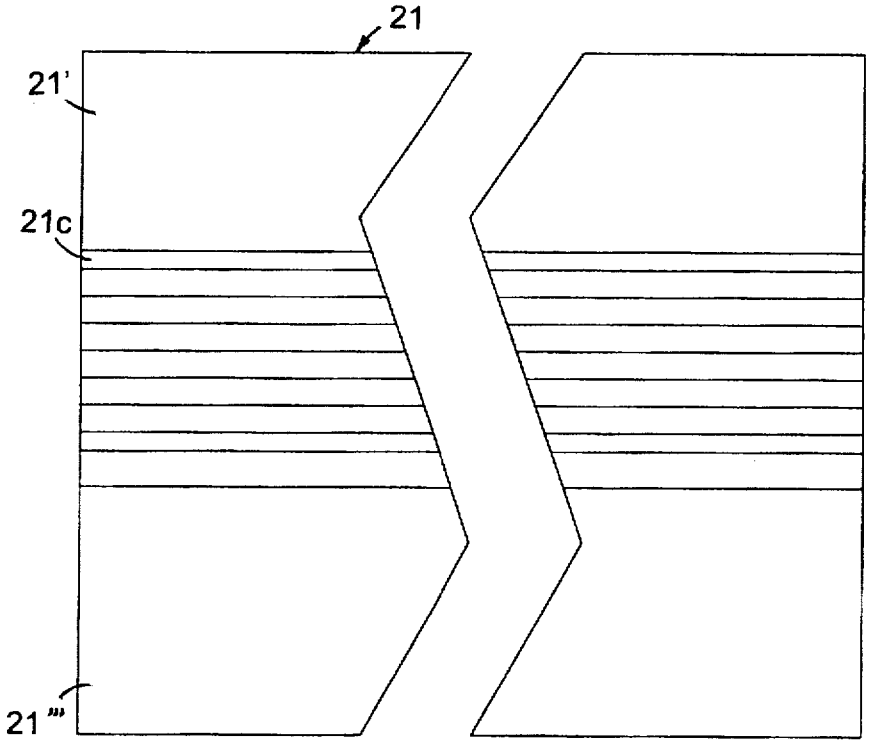
FIG. 5 is a side elevational fragmentary view of the seal in FIG. 4.

Fitted into groove 19 is a peripheral elongated gasket seal 21 (FIG. 4). This gasket has a head 21', a main body portion 21", and a base portion 21'". Seal 21 is formed of a resilient polymeric material such as silicone rubber. It has sufficient flexibility to bend around comers in order to extend around cavity 34. Head portion 21' has a convexly curved top **21*b*, the arc of curvature of this surface 21*b* being large. Head portion 21' also has a lip 21*a* extending laterally on at least one side of the head to rest on platen shoulder 18*a* (FIG. 3) when the seal is installed in groove 19 as explained hereinafter. The body 21" of seal 21 has a pair of side wall portions on opposite sides, each having a plurality, here three, of outwardly extending, resilient, elongated, flexible ribs 21*c*, each of which is tapered toward the outer end thereof. Lip 21*a* of head 21' preferably projects laterally beyond the ribs. The combined width of the seal body, including ribs 21*c*, is greater than the width of groove 19, but the width of seal body 21", less the ribs 21*c*, is smaller than the width of groove 19. The concave bottom curvature of groove 19 generally corresponds to the convex curvilinear configuration of seal bottom portion 21'"**.

Seal member 21 can be forcefully inserted into groove 19 around the entire tray cavity until the bottom portions of the groove and seal interfit. The seal is pressed down into the cavity until the convex bottom 21'" engages the bottom of groove 19, and lip **21*a'* rests on shoulder 19*a*. During this insertion process, resilient ribs 21*c* are in engagement with the side walls of groove 19 to be resiliently deformed upwardly, i.e., in the opposite direction as the inserting force. Lip 21*a* of seal 21 engages the shoulder 19*a* between groove 19 and recess 34, while head 21' remains above the platen surface area 18'**.

Seal 21 can be formed as by extrusion. A desired length may be cut to extend completely around cavity 34 so that the ends abut.

Extending around the groove and seal, but spaced slightly therefrom, are a plurality of depressible pins in holes **18*b*** formed into the platen for this purpose, as disclosed in detail in the previously identified copending application.

In use, after the seal member has been inserted into the groove 19, trays T are placed in the cavities 34 so that the peripheral flanges F thereof rest on seal members 21. The trays can be filled with contents such as food either before placement in the cavities or after insertion. A lid is placed on the tray flange, aligned by the depressible pins surrounding it. The platen is then moved beneath an upper platen of the type set forth in the above-identified copending application. The upper platen is lowered and pressed against the lid, the tray flange and seal 21, and heat is applied to activate an adhesive between the tray flange and lid. This bonds the lid to the tray flange, after which the upper platen is raised, the lower platen 18 is moved from beneath the upper platen, and the sealed trays with contents therein are removed from cavities 34.

When seal 21 becomes deformed or otherwise deteriorates after a period of use, it can be readily replaced by persons without special skill, by simply pulling the seal member out of the groove and inserting a new seal member of the same type.

The above description is considered that of the preferred embodiment(s) only. Modifications of the invention will occur to those skilled in the art and to those who make or use the invention. Therefore, it is understood that the embodiment shown in the drawings and described above is merely for illustrative purposes and not intended to limit the scope of the invention, which is defmed by the following claims as interpreted according to the principles of patent law, including the doctrine of equivalents.

The embodiments of the invention in which an exclusive property or privilege is claimed are defined as follows:

1. A peripheral seal for apparatus to seal a container flange to a lid, comprising:

an elongated, resilient, polymeric seal member having sufficient flexibility to bend around corners, said seal member having a head portion and a pair of opposite side wall portions;

said side wall portions having a plurality of outwardly extending, resilient, flexible ribs, bendable into gripping relationship with a groove of a width less than the width of said seal member; and said head portion having a lip extending beyond said ribs on at least one side of said seal member.

2. The peripheral seal in claim 1 wherein said ribs have outer ends and are tapered convergently toward said outer ends.

3. The peripheral seal in claim 2 wherein said seal member has a bottom which is arcuately convexly curved.

4. The peripheral seal in claim 1 wherein said seal is of silicone polymer.

5. The peripheral seal in claim 1 wherein said head portion is convexly curved and compressible.

6. A platen and peripheral seal apparatus for sealing a container flange to a lid comprising:

a platen having a container receiving cavity therein, and having a peripheral surface around said cavity;

a peripheral groove in said platen surface, adjacent and around said cavity, and defining a remaining platen shoulder between said groove and said cavity;

an elongated, resilient, polymeric, peripheral seal member having a bottom portion and side wall portions in said groove, and having a head portion protruding beyond said groove;

said side wall portions having a plurality of outwardly extending, resilient, flexible ribs bendably deformed into gripping relationship with said groove, said groove having a width less than the width of said seal member including said ribs when said ribs are in a relaxed undeformed state.

7. The platen and peripheral seal apparatus in claim 6 wherein said head portion has a lip extending outwardly beyond said ribs over said platen shoulder.

8. The platen and peripheral seal apparatus in claim 7 wherein said ribs are convergently tapered outwardly.

9. The platen and peripheral seal apparatus in claim 6 wherein said bottom portion has a configuration matching that of said groove.

10. The platen and peripheral seal apparatus in claim 9 wherein said configuration is arcuate.

11. The platen and peripheral seal apparatus in claim 8 wherein said head portion is convexly curved.

12. The platen and peripheral sea apparatus in claim 6 wherein said groove has a width greater than said seal less said ribs.

* * * * *

UNITED STATES PATENT AND TRADEMARK OFFICE

CERTIFICATE OF CORRECTION

PATENT NO. 5,791,120
DATED August 11, 1998
INVENTOR(S) Perry R. DeYoung

It is certified that error appears in the above-identified patent and that said Letters Patent is hereby corrected as shown below:

Column 2, line 32;

"comers" should be –corners--.

Column 2, line 42;

"comers" should be –corners--.

Column 2, line 51;

After "tapered" insert –convergently--.

Signed and Sealed this

Ninth Day of February, 1999

*Attest:*

*Attesting Officer*

*Acting Commissioner of Patents and Trademarks*